United States Patent [19]

Maloof

[11] 4,266,476

[45] May 12, 1981

[54] CAP PRINTING APPARATUS

[76] Inventor: Ferris A. Maloof, Box 778, McCaysville, Ga. 30555

[21] Appl. No.: 30,635

[22] Filed: Apr. 16, 1979

[51] Int. Cl.[3] ..... B41F 17/00

[52] U.S. Cl. ..... 101/35; 101/114; 101/126; 101/115

[58] Field of Search ..... 101/114, 35, 126, 115, 101/41, 44, 407 BP, 9, 27, 38

[56] References Cited

U.S. PATENT DOCUMENTS

| | | | |
|---|---|---|---|
| 1,252,043 | 1/1918 | Shourt | 101/38 A |
| 1,974,634 | 9/1934 | Warzhtel et al. | 101/35 |
| 2,105,378 | 1/1938 | Smith | 101/35 X |
| 2,904,916 | 9/1959 | Stahmann | 101/35 |
| 3,244,093 | 4/1966 | Vasilantone | 101/126 |
| 3,427,964 | 2/1969 | Vasilantone | 101/115 |
| 4,084,504 | 4/1978 | Fuchs | 101/126 X |
| 4,099,460 | 7/1978 | Bubley et al. | 101/126 X |

*Primary Examiner*—Edward M. Coven
*Attorney, Agent, or Firm*—Louis T. Isaf

[57] ABSTRACT

A cap painting apparatus for printing on the curved surfaces of baseball caps and like pre-formed caps comprises a curved hat platform for supporting the cap with a panel of the cap positioned on a curved printing area of the platform. A clamping device holds the cap stretched tightly in place and a curved screen frame including a printing screen curved to conform to the curvature of the hat platform printing area fits over the hat platform with the screen in alignment with the platform printing area for contacting the convex surface of the baseball cap on the platform. A support structure adjustably supports the hat platform and the screen frame relative to one another.

6 Claims, 5 Drawing Figures

CAP PRINTING APPARATUS

DESCRIPTION

Background of the Invention

The present invention relates generally to the field of printing and more specifically to silk screen printing of shaped curved surfaces of baseball caps and the like.

Baseball caps and other like caps are shaped or formed into a curved hat surface and a somewhat rigid bill is attached to one portion or panel of the curved hat surface. Printing of numbers, letters or other designs on the curved hat portion presents many problems. The curved hat portion can be "printed" by heat transfer during which a decal is pressed onto the surface of the hat using heat. Heat transfer can be performed after the cap has been shaped or formed by placing the cap on a small curved buck, placing a decal on the cap surface and pressing the decal onto the cap surface with a heated curved iron. The heat transfer decal can crack, or flake, or peel off from the hat surface. Furthermore, a separate decal must be purchased or made by the cap printer thus adding money and/or time to the cap printing process.

Silk screen printing can be a less expensive method of printing a great number of caps since one screen or series of screens can be used repeatedly to print a multitude of caps. Typically, silk screening of hats has been done by the manufacture of the caps by silk screening onto the flat panels of the hat before they are formed into the curved hat surface. The silk screening process demands that the material being printed be held very securely and immovably and that the material be stretched tightly to avoid slippage and crawling which can otherwise ruin the printed design. Prior silk screening machines have been generally designed to print on flat surfaces but do not print satisfactorily on curved (i.e., concave or convex) surfaces which cannot be stretched out on a single flat plane. Cap distributors, such as wholesalers and retailers, who desire to sell caps in large numbers, for example to high school or college teams, generally are forced to pre-order silk screened caps from the manufacturers. To pre-order, distributors must know in advance how many caps bearing a certain design they wish to purchase, thus preventing the distributors from building up a large ready to sell stock and also creating difficulty in filling add-on orders. Among other disadvantages, this results in delay in servicing customers' needs and in loss of potentially greater profits. It is desirable that the distributor be able to silk screen the baseball caps after they have been manufactured and at his own place of business.

SUMMARY OF THE INVENTION

Briefly described, the present invention comprises a buc or platform with a curved upper surface for conforming generally to the inner curvature of a baseball cap placed over the platform. A silk screening screen is held in an arcuate form for positioning over the platform by a screen frame curved to mesh with the curved upper surface of the platform. A curved printing platform rises above the curved upper surface of the platform for location under the cap panel to be printed. A cap clamping device is associated with the platform for holding a cap securely on the platform and stretching the cap panel to be printed tightly over the printing platform. The platform and screen are adjustable relative to one another for positioning a cap placed over the platform accurately under the frame. The present invention further comprises a positioning device for accurately positioning consecutive screen frames in an aligned position over the platform to facilitate multicolor printing of caps.

Therefore, it is an object of the present invention to provide a cap printing apparatus for silk screen printing of the curved panels of caps in their pre-formed state.

Another object of the present invention is to provide a cap printing apparatus for printing on curved surfaces.

Still another object of the present invention is to provide a cap printing apparatus for silk screening multiple color designs to the curved surfaces of a pre-formed cap.

Other objects, features and advantages of the present invention will become apparent upon reading the following specification, when taken in conjunction with the accompanying drawings.

DETAILED DESCRIPTION

Figures 1, 1A:
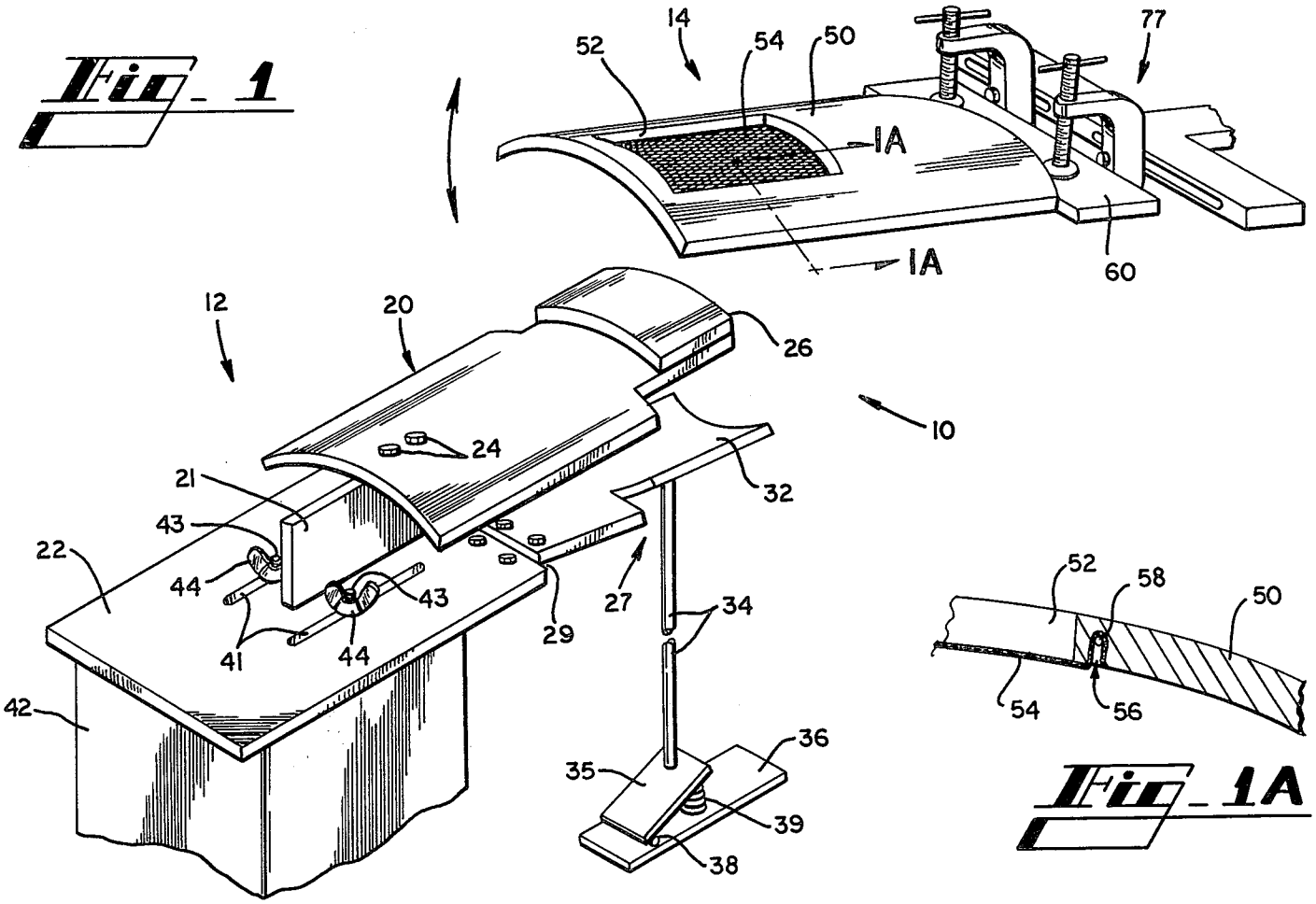
FIG. 1 is a perspective view of the cap printing apparatus of the present invention with the support structures removed for clarity of illustration.
FIG. 1A is a fragmented section of the cap printing apparatus of FIG. 1 taken along line 1A—1A.
Figure 2:
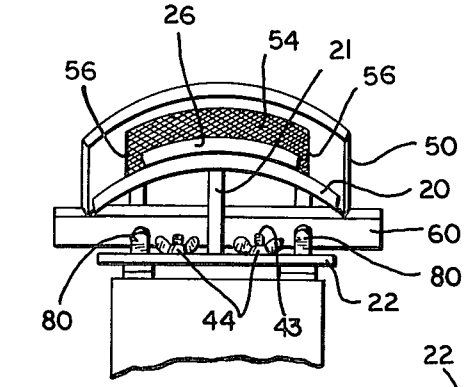
FIG. 2 is an end view of the cap printing apparatus of FIG. 1.

Referring now in more detail to the drawings in which like numerals represent like components throughout the various views, FIG. 1 shows the cap printing apparatus 10 of the present invention which in its preferred embodiment comprises a curved surface silk screening apparatus 10. As seen in FIGS. 1, 1A and 2, the curved surface silk screening apparatus 10 comprises a platform assembly 12 and a screen assembly 14. The platform assembly 12 includes a curved buc or hat platform 20 mounted on a vertical support 21 above a horizontal base plate 22. The buc 20 is attached to the vertical support 21 by bolts 24 and the curved buc 20 is concave downward as seen. A printing area or printing platform 26 is formed at one end of the buc 20 opposite the attachment bolts 24. In the preferred embodiments as shown in the drawings, the printing area 26 is a raised curved platform 26, including a convex upper surface, positioned above the normal surface of the buc 20. An elongated opening 41 is defined through the base plate 22 on each side of the vertical support 21. The base plate 22 is slidably mounted to a stand 42 or other appropriate support means by bolts 43 extending through the elongated openings 41 and tightened by wing nuts 44.

A hat clamp assembly 27 is positioned below the buc 20 and includes a clamp plate 28 pivotably mounted by a hinge 29 to one end of the base plate 22 beneath the printing area 26 of the buc 20. The clamp plate 28 includes a curved cap engaging portion 32 which is oriented concave upward. A long bar 34 extends from the bottom of the clamp plate 28 to a foot peddle 35 mounted to a floor pad 36. The foot peddle 34 is pivotable about a hinge 38 and is biased in an up position by a spring 39 placed under the foot peddle.

The screen assembly 14 includes a curved screen frame 50 or cap engaging cover member 50. The screen frame 50 is concave downward and the lower, concave surface 51 of the screen frame comprises a curvature which meshes with or conforms to the curvature of the hat platform 20. A rectangular window 52 is formed in the screen frame 50 at one end of the frame and a conventional silk screening screen 54 covers the window at the bottom surface of the screen frame. A channel 56 (see FIG. 1A) is formed in the screen frame 50 adjacent all four sides of the rectangular window 52 and the four edges of the silk screening screen 54 are tucked into the channel to hold the screen 54 stretched across the window. A length of cord 58, or other stuffing material, is packed into the channel 56 to hold the edges of the screen 54 in the channel. A flat rectangular mounting ledge 60 is attached to the curved screen frame 50 at the end of the screen frame 50 opposite the window end of the frame.

Figure 3:
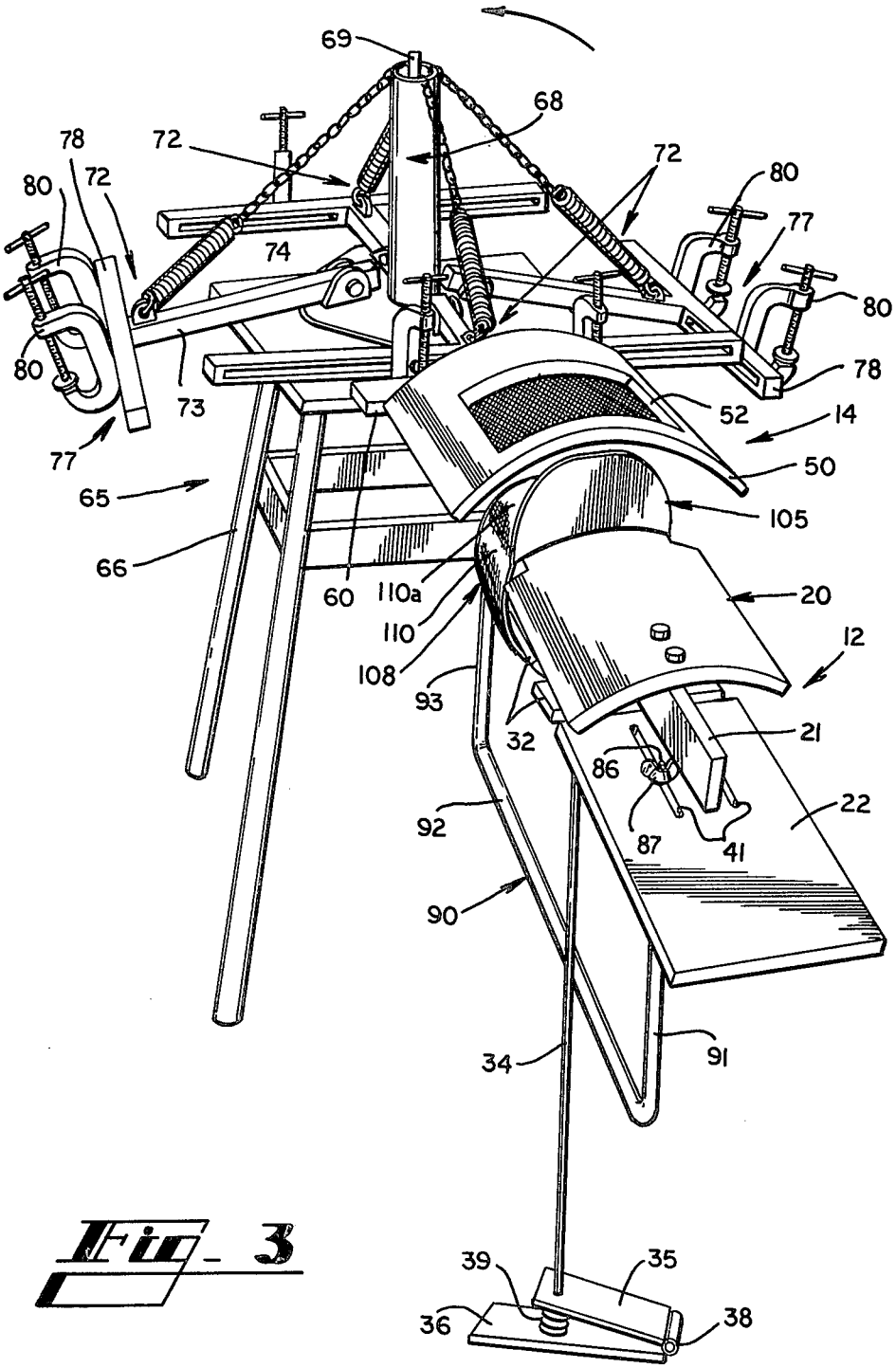
FIG. 3 is a perspective view of the cap printing apparatus of FIG. 1 including a four-armed support structure.

In a first mode of usage of the preferred embodiment, as seen in FIG. 3, the platform assembly 12 and screen assembly 14 are both mounted for use on a conventional silk screening support structure 65. The support structure 65 shown in FIG. 3 is usable for multi-color silk screening and includes a four-legged stand portion 66 and a four-armed turnstile 68 mounted for rotation about a central vertical axis 69 on top of the stand. The turnstile 68 has four arm assemblies 72 and each arm assembly 72 includes a rectilinear shaft 73 pivotable through a horizontal plane about a pin 74 of the turnstyle near the center of the support structure 65. A frame-clamp assembly 77 is attached to the outer end of the shaft 73 opposite the pin 74. The frame-clamp assembly 77 includes a horizontal bar 78 attached perpendicular to the shaft 73 and two screw clamps 80 mounted on the bar 78, one clamp to each side of the horizontal shaft 73, with the clamp opening outward.

One screen assembly 14 is releasably mounted to each arm 72 of the support structure turnstile 68 by clamping the screw clamps 80 about the rectangular mounting ledge 60 of the screen assembly. The platform assembly 12 in the embodiment of FIG. 3, is adjustably attached to a mounting plate 85 which plate 85 is mounted at the top end of an approximately vertical section 91 of a support bar 90. The support bar 90 and mounting plate 85 function as the stand or support means 42 of FIG. 1. Bolts 86 extend from the mounting plate 85 through each of the elongated openings 41 of the base plate 22, and wing nuts 87 on the bolts hold the base plate 22 of the platform assembly 12 tightly onto the mounting plate 85. The support bar 90 is bent to include a first approximately vertical section 91, lower horizontal section 92, second vertical section 93 and upper horizontal section 94. Reference should be made here to the support bar 90 of FIG. 4 which is comparable to the support bar of the support structure 65 in FIG. 3. The upper horizontal section 94 of the support bar 90 is held firmly within an orifice (not shown) defined in the stand 66 just below the turnstile 68 and, thus, the support bar 90 supports the platform assembly 12 suspended to the side of the support stand 65. A generally V-shaped arm guide 99 is mounted on the upper horizontal section 94 of the support bar 90 by a releasable clamp with the two legs of the guide protruding above the support bar. The arm guide 99 is not seen in FIG. 3 but a comparable arm guide 99 is seen from a side view in FIG. 4. The arm guide 99 is adjustably positioned along the bar 90 for supporting and aligning the arm 72 in the manner known in the art.

Figure 4:
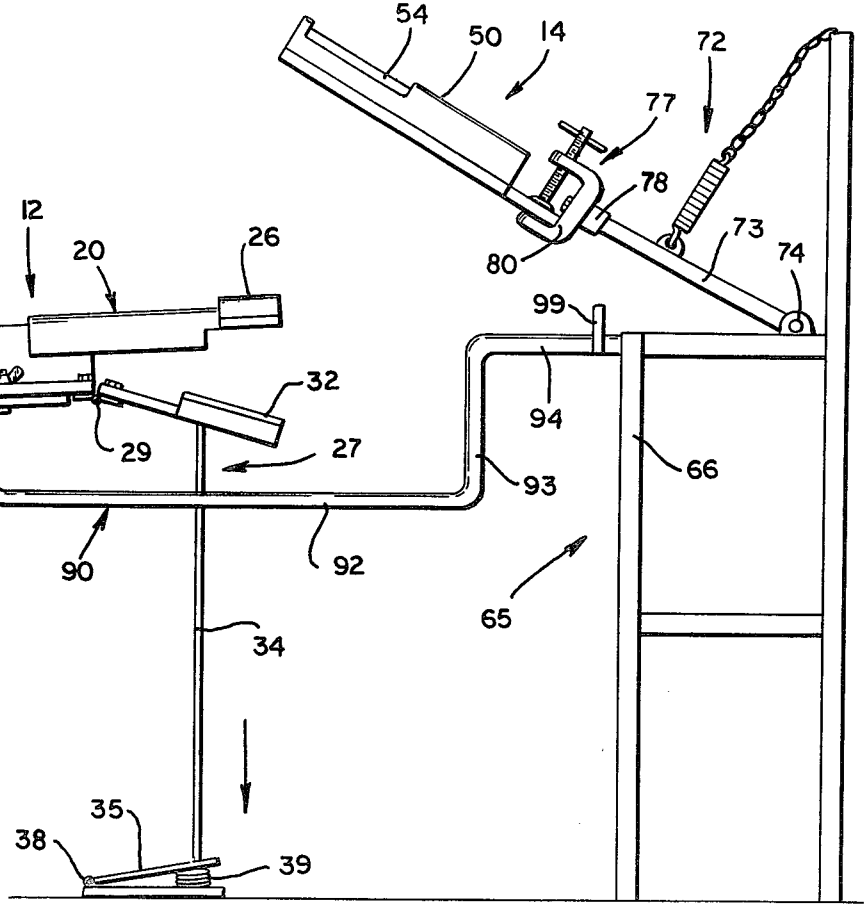
FIG. 4 is a side view of the cap printing apparatus of FIG. 1 including a one-armed support structure.

FIG. 4 shows the platform and screen assemblies as being mounted on a support structure 65 which is used for single color silk screening and requires the presence of only one arm assembly 72. There is no turnstile in this one armed embodiment but other features of the support structure 65 of this second embodiment are similar to that in FIG. 3. The arm assembly 72 includes the frame-clamp assembly 77 attached to the rectilinear shaft 73 all of which is pivotable about a pin 74 mounted on a four-legged stand 66. A support bar 90 of the configuration previously described in conjunction with the structure of FIG. 3 extends from an orifice (not shown) in the stand 66 in the same vertical plane as the rectilinear shaft 73 to support the platform assembly 12 on a mounting plate 85 as previously described in conjunction with FIG. 3. An arm guide 99 is adjustably mounted on the upper horizontal section 94 of the support bar 90.

When finally assembled for use in accordance with the modes of usage discussed above, one screen assembly 14 is attached to each pivoting arm 72 of the support structure 65. The support bar 90 extends rigidly from the orifice 96 to support the platform assembly 12 suspended adjacent the support structure 65 at a predetermined position relative to the screen assembly 14 as discussed below. The floor pad 36, to which the foot peddle 35 is attached, rests on the floor with the long bar 34 extending upward and connecting to the clamp plate 28. The spring 39 biases the foot peddle and thus the clamp plate upwardly toward the buc 20.

While the present disclosure shows the platform assembly 12 and screen assembly 14 as being supported by support structures 65 of particular embodiments, these structures are a matter of design preference and various other support structures which function within the spirit and scope of this specification to position and adjust the position of the platform and screen assemblies and offer them support are equally contemplated herein.

OPERATION

In operation, the apparatus 10 is assembled as previously described and a baseball cap 105, or like "permanently" curved hat, is slipped over the buc 20 with the buc extending into the opening 107 of the hat portion 108 (that is, the head covering portion) of the cap. Likewise, the clamp plate 28 extends into the opening 107 at the opposite side of the hat portion 108 from the buc 20. A curved panel 110 of the cap 105, for example, front panel **110*a*, which is to be printed is positioned directly on top of the printing area 26 with the convex surface of the printing area engaging the inner concave surface of the cap front panel. The foot peddle 35, long bar 34 and spring 39 function to move the clamp plate 28 about the hinge 29. The spring 39 normally biases the foot peddle, long bar and clamp plate 28 upwardly toward the buc platform 20. The operator pushes down with a foot on the foot peddle 35 to overcome the spring bias and pull the clamp plate downwardly away from the buc 20 thus holding the cap 105 firmly in place on the buc and stretching the front panel 110*a* tightly over the raised, curved printing platform 26**.

A printing screen 54, such as a silk screening screen 54, is prepared for use by "burning" the design into the screen in the typical manner known in the art of silk screening. That is, the silk screening screen 54, is preferably prepared in the typical manner of attaching typical silk screening material (i.e. nylon, silk, polyester, etc.) to a flat frame, coating the material with a light sensitive emulsion, and exposing the flat, coated screen in a darkroom to light transmitted through a transparent positive of the design. The typical silk screening printing screen 54 known in the art comprises a flat but not rigid sheet of meshed material such as nylon, silk or polyester treated as above. The typical silk screening screen is flexible in that it can be bent or twisted without damage. Generally, the typical screen is non-malleable in that it will not retain the shape to which it is bent or twisted. The screen 54, preferably rectangulr in shape, is mounted onto the bottom surface of the screen frame 50 by stretching the screen tightly across the window 52, tucking the sides of the screen into the adjacent channels 56 and stuffing the cord 58 firmly into the channels to hold the screen in place. The screen 54 may be attached to the screen frame in any other appropriate manner. When in place, the screen 54 is tightly stretched across the window 52 and follows the curvature of the screen frame 50. For multicolor printing, a separate screen assembly 14 is prepared for each color used, for example, on the embodiment of FIG. 3, a separate screen 54 and screen frame 50 is prepared for each arm assembly 72 and is attached to the respective frame clamp assembly 77 as previously described.

The curvature of the printing area 26 of the buc 20 conforms generally to the curvature of the pre-formed, curved hat portion 108 of a typical baseball cap 105, or like cap. The curvatures of the buc printing area 26 and cap 105, however, are not necessarily equal as the buc printing area generally has a permanent curvature and the cap curvature will vary depending upon the hat size. Furthermore, the curvature of the buc printing area 26 can be varied as a matter of design preference to most advantageously display the cap panel 110 for printing. The curvature of the lower surface 51 of the screen frame 50 conforms generally to the curvature of the buc printing area 26 in order to cooperate with the buc printing area 26 to print the cap panel 110. However, the curvature of the lower surface 51 of the screen frame 50 is not necessarily equal to the curvature of the buc printing area 26.

The turnstile 68 of the four-armed structure of FIG. 3 is rotated about the horizontal axis 69 until one of the arm assemblies 72 is adjacent the platform assembly 12 with the rectilinear shaft 73 aligned in the same vertical plane as the support bar 90. (The structure of FIG. 4 is already so aligned). The arm assembly 72 is then pivoted about the pin 74 to bring the screen frame 50 down over the buc 20 and cap 105. Preferably, the platform assembly 12 and screen frame 50 are aligned relative to one another such that the window 52 will pivot into position directly over the printing area 26 and the cap panel 110*a* to be printed.

The screen frame 50 is pressed against the cap 105 and buc 20 in order to achieve good tight contact between the panel 110*a* to be printed and the printing screen 54. As earlier stated, the printing area 26 includes preferably a raised printing platform 26 to aid in the achievement of good panel-screen contact by holding the panel 110*a* above the buc surface 20 and thus "pushing" the cap panel 110*a* into the window opening 52 and into the screen 54. To this end, it is preferable that the window 52 is made larger, that is, wider and longer than the raised printing platform 26 in order that the printing platform will protrude into the window to stretch the screen 54. The printing platform 26 is preferably made to a size having a width dimension (left to right as seen in FIG. 4) which is narrower than the depth of the hat portion 108 of the cap 105. In this way, the platform 26 can fit within the hat portion 108 beyond the bill portion to best contact and display the panel to be printed 110*a* of the cap 105 (see FIG. 3). Furthermore, the respective curvatures of the printing platform 26 and of the lower surface 51 of the screen frame 50 cooperate to facilitate good and continuous panel-screen contact. With the cap 105 held in place, the cap panel 110*a* stretched tightly over the raised printing platform 26 by the hat clamp assembly 27, and the screen frame 50 pivoted into position with the screen 54 in good contact with the cap panel 110*a*, printing ink is poured into the window 52 from above the screen and worked through the screen onto the cap panel to print the design on the cap panel in the typical manner associated with the silk screening process.

It should also be noted that the platform assembly 12, or at least the buc 20, is preferably oriented at a slight incline (see FIG. 4) with the end of the buc 20 possessing the printing area 26 being positioned higher than the other end of the buc. This inclining is intended to aid in the achievement of good panel-screen contact.

If a multicolor design is desired, the first screen assembly 14 is removed from above the buc 20 and another screen assembly is placed over the buc 20 in a predetermined position to effect proper color and design alignment. Referring to the embodiment of FIG. 3, the first arm assembly 72 is pivoted upwardly away from the platform assembly 12 and the turnstyle 68 is rotated about the vertical axis 69 to successively bring a second, third and fourth arm assembly 72 into position adjacent the platform assembly. Each arm assembly 72 is pivoted downwardly to position its screen 54 on the cap panel 110*a* in the manner previously described. A different color ink is applied through the screen 54 of each screen frame 50 to print a different color on the cap panel 110*a* in accordance with the design burned into the particular screen.

Proper alignment of the screen 54, printing platform 26 and cap panel 110*a* can be accomplished by adjusting the relative positioning of the platform assembly 12 and screen assembly 14. With reference to the embodiments of FIGS. 3 and 4, a first adjustment is made by twisting the support bar 90 about its axis (that is, about the axis of the upper horizontal section 94) within the orifice 96 of the support structure 65 to properly align the printing platform 26 within the window 52. A second adjustment is made by loosening the wing nuts 89 (see 44 of FIG. 1) holding the platform base plate 22 to the mounting plate 85, sliding the platform assembly 12 forwardly or backwardly on the mounting plate and retightening the wing nuts. Further adjustments are made by moving the screen assembly 14 within the frame clamp assembly 77 and then tightening the screw clamps 80 about the screen frame mounting ledge 60.

Proper alignment of the screen 54 and cap panel 110*a* is further aided by the arm guide 99. Each time an arm assembly 72 is pivoted downwardly toward the platform assembly 12, the shaft 73 of the arm assembly is placed within the "V" of the arm guide 99. The use of the arm guide 99 allows each arm assembly 72 to be positioned in the same angular location about the vertical axis 69 as each other arm assembly whenever the arm assembly is being used for printing.

Although the present disclosure refers specifically to an apparatus used for silk screen printing, the present invention is not to be limited by that particular method of printing as any printing method which utilizes the concepts of the present invention is equally contemplated herein.

While this invention has been described in detail with particular reference to preferred embodiments thereof, it will be understood that variations and modification can be effected within the spirit and scope of the invention as described hereinbefore and as defined in the appended claims.

I claim:

1. Apparatus for silk screen printing on curved flexible panels of baseball caps and like objects, said apparatus comprising;

a curved printing platform for supporting a panel of a cap thereon, said platform defining a predetermined curvature;

cap shaping means associated with said platform for causing a flexible panel of a cap supported by said platform to take a curvature conforming to said predetermined curvature of said platform;

a flexible silk screening printing screen;

means for transferring ink through said printing screen to a panel supported on said printing platform;

means for maintaining said printing platform and said printing screen stationary relative to one another in a print position during the transfer of ink through said printing screen to a panel on said printing platform; and screen shaping means for causing said silk screening printing screen to take a curved configuration defining a curvature which cooperates with said predetermined curvature of said platform to enhance the transfer of ink to the panel, whereby the printing screen and the panel which is to be printed are formed into cooperating curved configurations by which the transfer of ink to the panel can be effected.

2. Apparatus of claim 1, wherein said cap shaping means comprises a movable clamp member and means for moving said clamp member toward and away from said printing platform.

3. Apparatus of claim 1, wherein said cap shaping means comprises a movable clamp member positioned below said printing platform and means for moving said clamp member toward and away from said printing platform.

4. Apparatus of claim 1, wherein said screen shaping means comprises:

a curved frame member defining said curvature which cooperates with said curvature of said platform;

an opening defined in said frame member;

screen holding means for attaching said printing screen to said frame member in a position spanning said opening, said screen holding means including means for retaining said screen in a curve defining a curvature conforming to said curvature of said frame member.

5. Apparatus of claim 1, further comprising means for moving said printing screen toward said printing platform to a print position and away from said printing platform to a non-print position while said screen is in said curved configuration.

6. Apparatus of claim 1 further comprising:

a plurality of flexible, silk screening printing screens;

a screen shaping means associated with each said screen for causing said screen to take a curved configuration defining a curvature which cooperates with said curvature of said platform to enhance the transfer of ink to the panel; and means for moving each said printing screen toward said printing platform to a print position and away from said printing platform to a non-print position while said screen is in said curved configuration.

* * * * *